US005549492A

United States Patent [19]

Yamamoto et al.

[11] Patent Number: 5,549,492

[45] Date of Patent: Aug. 27, 1996

[54] OUTBOARD MOTOR

[75] Inventors: Manabu Yamamoto; Takio Ogasawara; Toshihiro Nozue, all of Hamamatsu, Japan

[73] Assignee: Sanshin Kogyo Kabushiki Kaisha, Shizuoka-ken, Japan

[21] Appl. No.: 399,127

[22] Filed: Mar. 6, 1995

[30] Foreign Application Priority Data

Mar. 7, 1994 [JP] Japan ..... 6-059831

[51] Int. Cl.[6] ..... B03H 5/12

[52] U.S. Cl. ..... 440/53; 440/76

[58] Field of Search ..... 440/52, 53, 88, 440/900, 76, 77; 248/640; 114/144 R; 123/195 P

[56] References Cited

U.S. PATENT DOCUMENTS

| | | | |
|---|---|---|---|
| 3,599,594 | 8/1971 | Taipale | 440/53 |
| 3,782,321 | 1/1974 | Ellingsen | 440/52 |
| 4,303,401 | 12/1981 | Sanmi et al. | 440/88 |
| 5,295,879 | 3/1994 | Meier et al. | 440/52 |

*Primary Examiner*—Edwin L. Swinehart

*Attorney, Agent, or Firm*—Knobbe, Martens, Olsen & Bear

[57] ABSTRACT

An outboard motor incorporating a unitary mounting assembly for resiliently connecting the steering shaft to the driveshaft housing. The mounting assembly also closes an upper portion of the driveshaft housing and has an opening that passes a water tube for supplying cooling water to the engine of the outboard motor.

18 Claims, 4 Drawing Sheets

OUTBOARD MOTOR

BACKGROUND OF THE INVENTION

This invention relates to an outboard motor and more particularly to an improved arrangement for attaching the steering shaft of an outboard motor to its driveshaft housing.

Most conventional outboard motor constructions employ a clamping bracket that is adapted to be affixed in a suitable manner to the hull of the associated watercraft and which pivotally supports a swivel bracket for tilt and trim movement. The swivel bracket, in turn, journals a steering shaft for steering movement about a generally vertically extending steering axis when the swivel bracket is tilted down. The steering shaft is, in turn, resiliently connected to the driveshaft housing so as to support the remaining components of the outboard motor on the clamping bracket. The resilient support is employed for reducing the transmission of vibrations from the operation of the propulsion unit, including the powering internal combustion engine, to the hull.

Normally the driveshaft housing is a generally open casing made from a lightweight material such as an aluminum or aluminum alloy casting. This driveshaft housing is generally open at the top and the power head, including the powering internal combustion engine, is carried at the upper end of this driveshaft housing.

Conventionally the structure for attaching at least the upper end of the steering shaft to the driveshaft housing has been comprised of a lower mounting plate that is affixed to the driveshaft housing and which closes at least a portion of the top of the cavity. This plate forms a pair of recesses that receive elastic elements which, in turn, are connected to a steering bracket which is, in turn, connected to the steering shaft. A clamping plate is affixed to the mounting plate and holds the elastic element or elements in position, and thus completes the assemblage. It should be readily apparent that this type of construction requires a number of parts which require assembly, and which can work loose if their fasteners are not properly tightened.

In addition, the cooling water for the engine is normally supplied by a cooling water supply pipe that extends upwardly through the driveshaft housing casing in the area of the steering bracket attachment. This water supply pipe must, with previously proposed constructions, be bent to curve around the steering bracket and thus provides a relatively large assembly.

It is, therefore, a principal object of this invention to provide an improved and simplified arrangement for connecting a steering shaft to the driveshaft housing of an outboard motor.

It is a further object of this invention to provide an improved and simplified mounting arrangement for such a connection that minimizes the number of parts and the number of detachable connections.

It is a further object of this invention to provide a mounting arrangement for the steering shaft of an outboard motor to the driveshaft housing that will readily accommodate a cooling water supply pipe.

SUMMARY OF THE INVENTION

This invention is adapted to be embodied in a mounting arrangement for an outboard motor that is comprised of an outer casing. The mounting arrangement is comprised of a unitary assembly comprising a base plate portion that is affixed to the outer casing and an elastic element that is bonded to the base plate and defines an opening adapted to receive a fastener. A steering bracket is affixed to the steering shaft and is juxtaposed to the elastic element. A fastener is affixed to the steering bracket and passes through the opening for resiliently connecting the steering shaft to the outer casing.

DETAILED DESCRIPTION OF THE PREFERRED EMBODIMENTS OF THE INVENTION

Figures 1, 1A:
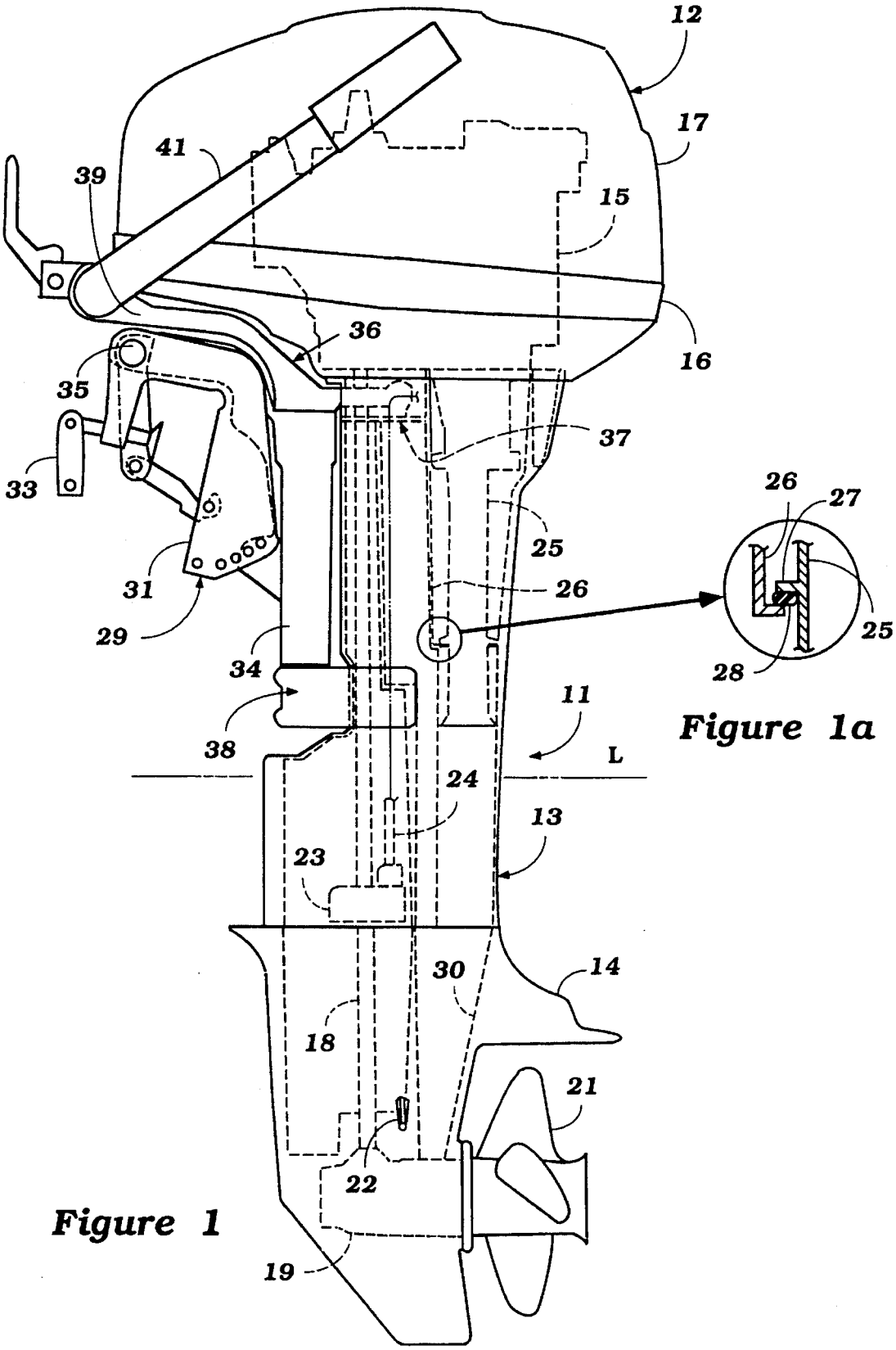
FIG. 1 is a side elevational view of an outboard motor constructed in accordance with an embodiment of the invention.
FIG. 1*a* is an enlarged view of the area encompasses by the circle in FIG. 1.

Referring now in detail to the drawings and initially primarily to FIG. 1, an outboard motor constructed in accordance with an embodiment of the invention is identified generally by the reference numeral 11. The outboard motor 11 is comprised of a power head assembly, indicated generally by the reference numeral 12 which is mounted at the upper end of a driveshaft housing, indicated generally by the reference numeral 13, and which is formed as a casting from a lightweight material such as aluminum or an aluminum alloy. A lower unit 14 is provided at the lower end of the driveshaft housing 13.

The power head 12 includes a powering internal combustion engine which may be of any known type and is shown only in outline form and indicated by the reference numeral 15. This engine 15 is supported on a lower tray assembly 16 which forms a portion of a protective cowling that encircles and protects the engine 15. This cowling is completed by an upper cowling member 17 that is detachably affixed to the tray 16 in any known manner.

As is typical with outboard motor practice, the engine 15 is supported in the power head 12 so that its output shaft rotates about a generally vertically extending axis. This output shaft is coupled in any known manner to a driveshaft 18 that depends through the driveshaft housing 13 and into the lower unit 14. The driveshaft 18 is journaled in any suitable manner. At its lower end, the driveshaft 18 is coupled through a forward neutral reverse transmission to a propeller shaft 19 on which a propeller 21 is affixed in a known manner.

The engine 15 is water-cooled and the water for its cooling is drawn from the body of water in which the outboard motor 11 is operating. This body of water is shown by the dot-dash line indicated by the letter L in FIG. 1. This shows the condition of the outboard motor when operating at relatively low speeds or when stationary. As the associated watercraft is propelled at a higher rate of speed, the water level L will lower relative to the outboard motor 11 from the position shown in FIG. 1. The outboard motor 11 raises relative to the water level L in actual practice.

This cooling water is admitted through the water inlet opening 22 formed in the lower unit 14. A water pump 23 is mounted at the interface between the driveshaft housing 13 and lower unit 14 and is driven by the driveshaft 18 in a known manner. This draws water through the inlet 22 and delivers it upwardly to the engine 15 through a supply conduit 24. Further details of this supply conduit will be described later by reference to the remaining figures.

The engine 15 discharges its exhaust gases down into a silencing arrangement provided within the driveshaft housing 13 through an exhaust pipe 25. The exhaust pipe 25 is affixed to the lower face of the engine 15 or to a supporting plate on which the engine 15 is mounted. This exhaust pipe extends into an expansion chamber formed at the rear of the driveshaft housing outer casing in part by a front integral wall 26 thereof. As may be seen in the encircled portion of the view of FIG. 1, the exhaust pipe 25 has an outwardly extending flange 27 that engages an elastic seal and support 28 so as to hold the spacing of the exhaust pipe 25 within the expansion chamber and to permit absorption of any relative vibrations and sound deadening.

The expansion chamber terminates at its lower end in an exhaust gas discharge 30 formed in the lower unit 14 for delivering the exhaust gases to the atmosphere back through the body of water in which the watercraft is operating. A conventional through the propeller hub exhaust gas discharge may be provided for this purpose. This is the high speed exhaust gas discharge and the outboard motor 11 may also be provided with any type of conventional above-the-water exhaust gas discharge for low speed operation.

It is to be understood that the description of the outboard motor 11 as thus far described may be considered to be conventional. Since the invention deals with the attachment of the steering shaft (to be described) to the outer casing of the driveshaft housing 13, it is believed that additional description of the components of the engine and propulsion system are not necessary to understand the invention. Reference may be had to any conventional construction to practice the invention.

Continuing to refer to FIG. 1, the outboard motor 11 also includes a clamping bracket, indicated generally by the reference numeral 29, which has a transom portion 31 that is adapted to engage the rear of the transom of an associated watercraft. A clamping device 33 is also carried by the clamping bracket 29 and cooperates to affix the clamping bracket 29 to the transom in a well known manner.

A swivel bracket 34 is affixed for pivotal movement to the clamping bracket 29 by means of a horizontally extending pivot pin 35. This pivotal connection permits tilt and trim movement of the outboard drive 11 relative to the hull of the associated watercraft, as is well known in this art. The components of the outboard motor which have been described comprised of the power head 12, driveshaft housing 13, and lower unit 14 are connected to the swivel bracket 34 by means of a steering arrangement, indicated generally by the reference numeral 36. This steering arrangement 36 includes a steering shaft which does not appear in FIG. 1, but which will be described and identified later in the remaining figures. This steering shaft is connected to the driveshaft housing 13 and specifically its outer casing by an upper resilient attachment mechanism 37, which embodies the invention, and a lower resilient attachment 38 which may be of any conventional type.

Figure 2:
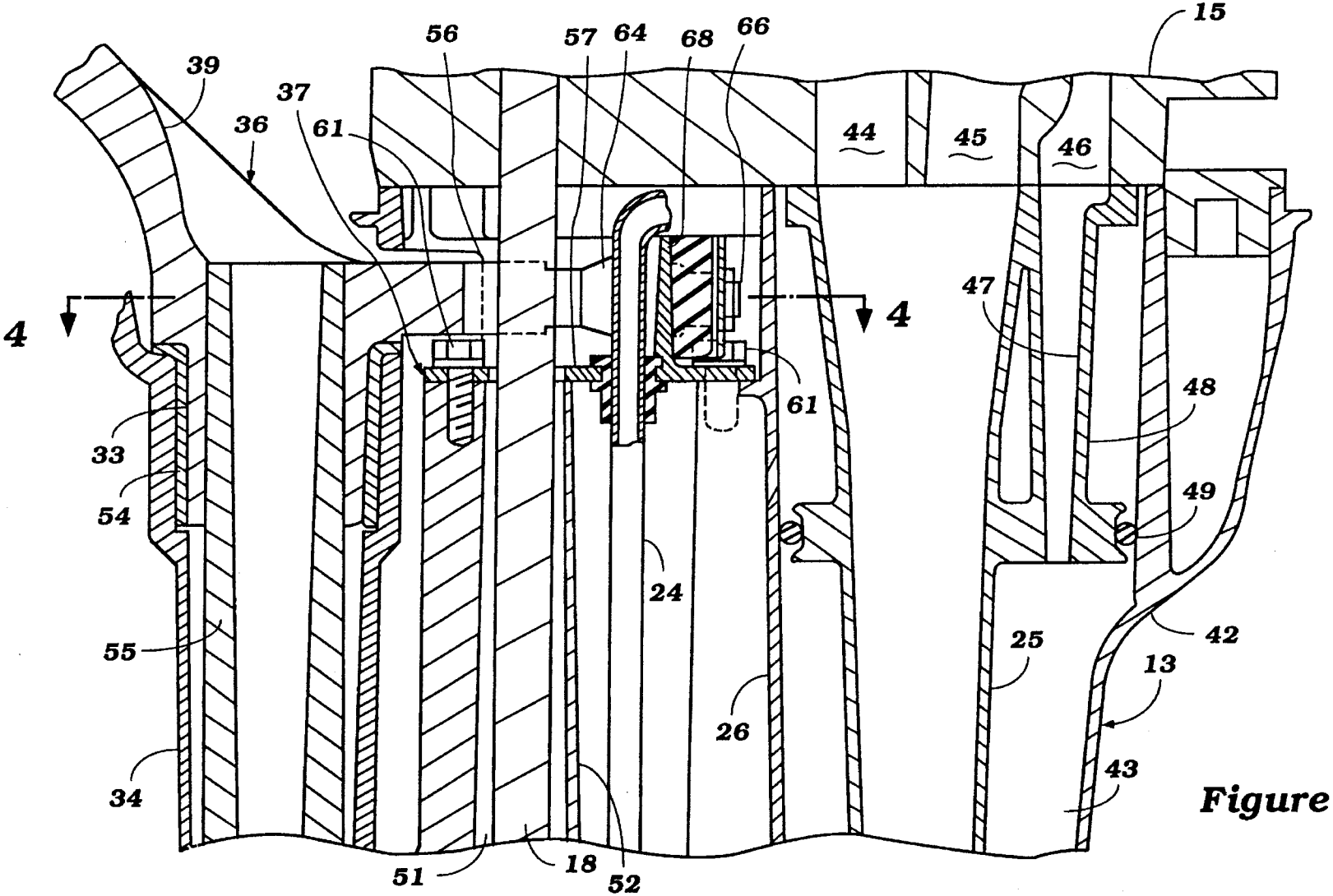
FIG. 2 is an enlarged cross-sectional view taken along the line 2—2 of FIG. 3 and shows the attachment of the steering shaft to the driveshaft housing.

The steering shaft and steering arrangement 36 includes a tiller 39 that is affixed to the upper end of the steering shaft in a well known manner and one which will be described later by reference to FIG. 2. A steering handle 41, which may contain other controls for the outboard motor 11, is pivotally connected to the tiller 39 for movement between a storage position as shown in FIG. 1 and an operative steering position where it extends horizontally and forwardly from the tiller 39. The structure of the outboard motor as thus far described may be considered to be conventional.

Referring now to the remaining figures, the connection between the steering shaft, the swivel bracket 34, and the driveshaft housing 13 will be described. Referring first to FIG. 2, the driveshaft housing 13 is comprised of an outer casing and this outer casing is indicated in the remaining figures by the reference numeral 42 and includes the inner wall 26 which, as has been noted, defines the expansion chamber, indicated by the reference numeral 43 in this figure.

The engine 15 has exhaust manifold portions 44 and 45 that extend downwardly and which deliver the exhaust gases, as has been noted, to the exhaust pipe 25. Also, the coolant which has been circulated through the engine from the water pump 23 is discharged through a water discharge port 46 formed in a lower portion of the engine 15 into a water discharge passageway 47 that is formed at one side of a portion 48 of the exhaust pipe 25. This passage 47 opens downwardly into the expansion chamber 43 so that the cooling water from the engine will be discharged along with the exhaust gases back into the body of water in which the watercraft is operating.

An elastic seal 49 is provided around the lower end of the exhaust pipe portion 48 and the inner surface of the driveshaft housing 45 above the expansion chamber 43.

Also, it should be noted that the driveshaft 18 rotates in a generally open cavity 51 formed in part by an integral wall 52 of the driveshaft housing casing 42.

Figure 3:
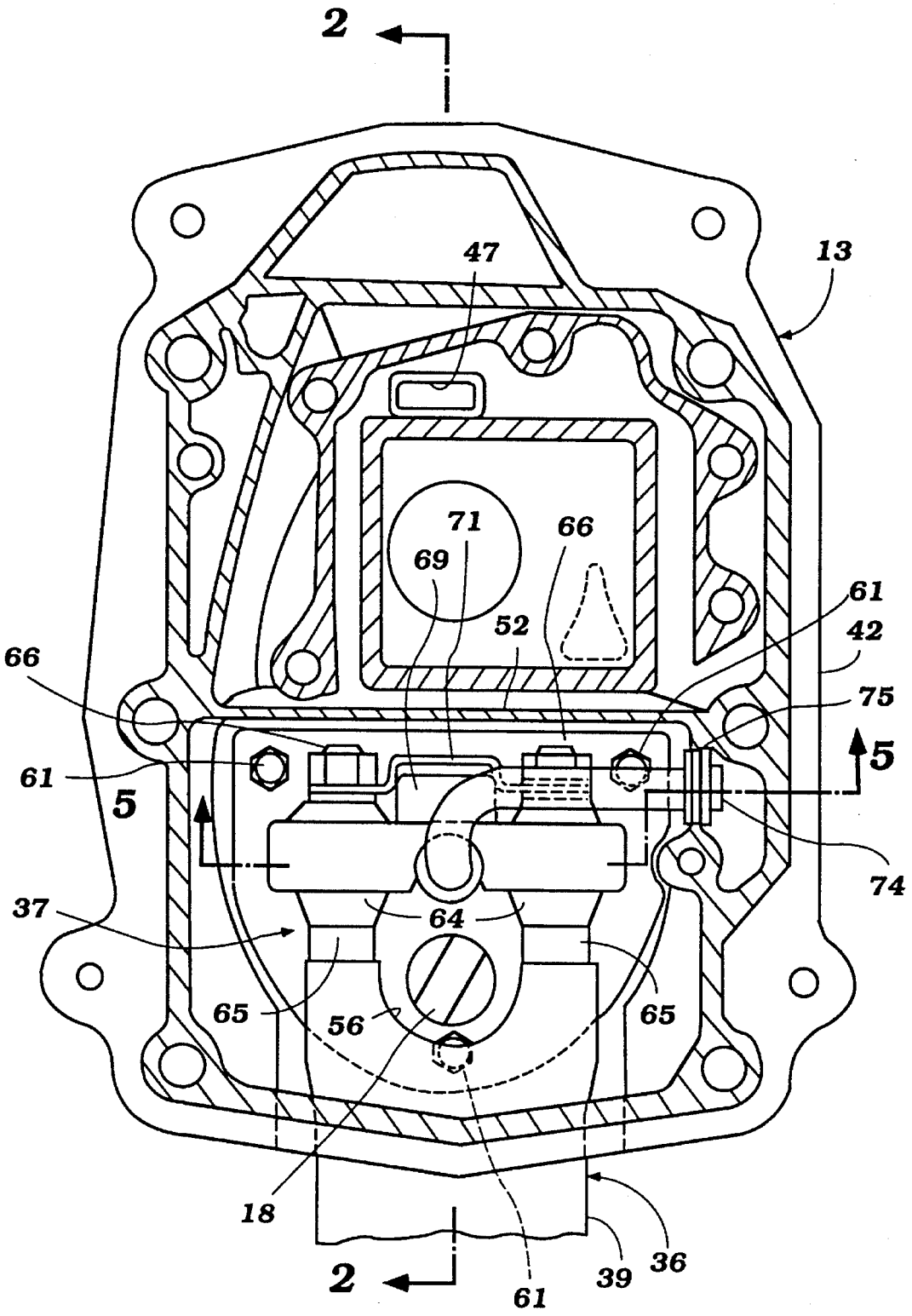
FIG. 3 is a cross-sectional view taken through the upper portion of the driveshaft housing immediately above the connection of the steering shaft to the driveshaft housing.
Figure 4:
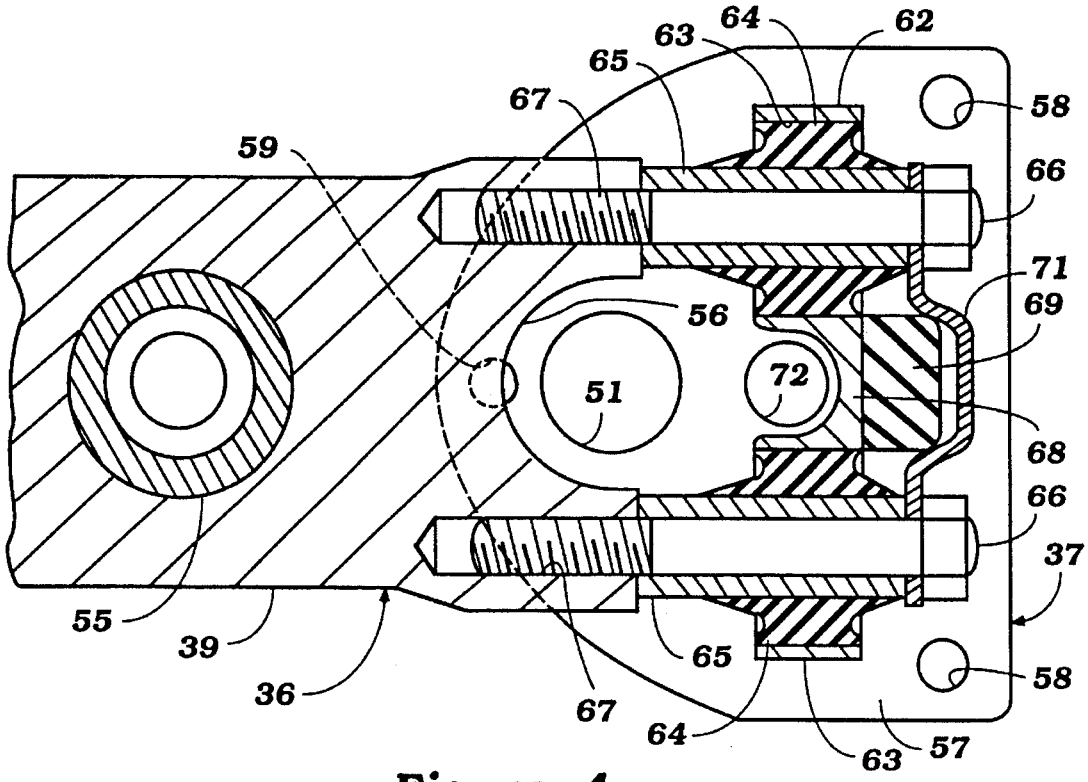
FIG. 4 is a further enlarged cross-sectional view taken along the line 4—4 of FIG. 2.
Figure 5:
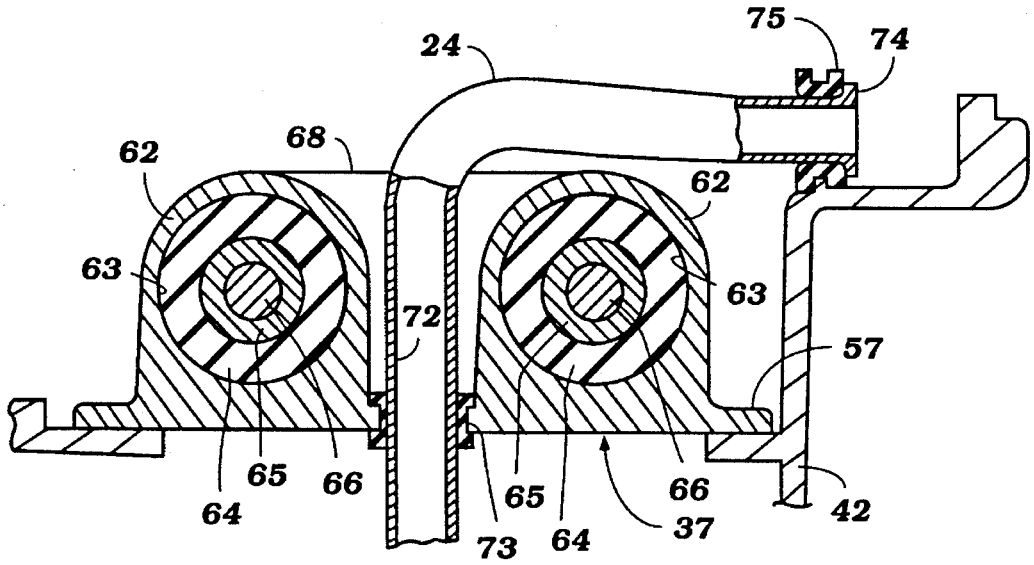
FIG. 5 is a further enlarged cross-sectional view taken along the line 5—5 of FIG. 3.

The mounting arrangement 37, is illustrated additionally in FIGS. 3–5. It will be noted that the tiller 39 has a cylindrical boss 53 that is journaled in the upper portion of the swivel bracket 34 by means of a bushing 54. A steering shaft 55 is affixed within this cylindrical portion 53 and has its lower end journaled in any suitable manner in the swivel bracket 34, as by another bushing (not shown).

In addition to the boss 53, the tiller 39 has a plate-like portion that extends rearwardly above the cavity 51 through which the driveshaft 18 passes. This portion is formed with an opening 56 which is generally forked in shape as best shown in FIGS. 3–4. It is to this fork-shaped portion that the connecting assembly 37 is connected.

The connecting assembly 37 is formed with a mounting base portion 57 which extends across and is supported on the upper portion of the wall 52 and upper surfaces of the interior of the driveshaft housing casing 42 so as to, in effect, close this portion of the driveshaft housing casing 42. For this purpose, the plate-like portion 57 is provided with a pair of rear openings 58 and a front opening 59 that pass threaded fasteners 61 for detachably affixing the mounting plate portion 57 to the driveshaft housing casing 42.

Rearwardly of the forked portion of the tiller 39, the plate-like portion 57 is provided with a pair of upstanding bosses 62. These bosses 62 are formed with cylindrical openings 63 into which the outer portions of elastomeric sleeves 64 are affixed as by bonding or vulcanizing. The elastomeric sleeves 64, in turn, have internal openings that are bonded or vulcanized to inner sleeves 65 which extend axially beyond the bosses 62 and the elastomeric elements 64. Threaded fasteners such as studs or bolts 66 are passed through these inner sleeves 65 and are threaded into tapped openings 67 formed in the fork-like portion of the tiller 39 so as to provide an elastic connection between the tiller 39 and the mounting assembly 37.

The bosses 66 are interconnected integrally by a bridge-like portion 68 and the rear end of this bridge-like portion has affixed to it as by bonding or vulcanization an elastomeric block 69. A retainer plate 71 is captured between the sleeves 65 and the fasteners 66 and engages this block 69 so as to provide further resilient support for the assembly and to provide stiffening in a fore and aft direction.

The described mounting arrangement 37, as should be readily apparent, provides an assembly made up of a minimum number of pieces, and yet one which can not only attach the driveshaft housing 43 to the steering shaft 53, but also form an integral closure for a portion of the upper end of the driveshaft housing casing 42. This assembly permits resilience both horizontally and vertically for damping, as is well known in this art. However, the construction described is much simpler than those previously employed without sacrificing any functions.

The plate portion 57 is provided with a central opening 72 between the bosses 62 and which receives an elastic grommet 73 through which the water supply tube 24 extends. The water supply tube 24 is bent at a right angle above one of the bosses 62 and extends transversely relative thereto to an end 74 that is supported by a grommet 75. A suitable water supply pipe (not shown) is attached to this end 74 and delivers the water to the cooling jacket of the engine.

From the foregoing description it should be readily apparent that the mounting arrangement is not only simple and compact, but also does not contain a large number of connections that could vibrate loose. Furthermore, the arrangement provides not only a closure for the upper portion of the driveshaft housing casing, but permits accommodation of the water supply pipe without excess bends and without large sides. Of course, the foregoing description is that of a preferred embodiment of the invention and various changes and modifications may be made without departing from the spirit and scope of the invention, as defined by the appended claims.

We claim:

1. A mounting arrangement for an outboard motor comprised of an outer casing, said mounting arrangement comprising a unitary assembly comprised of a base plate portion affixed rigidly and directly to said outer casing by at least a first threaded fastener and an elastic element bonded to said base plate and defining an opening adapted to receive a fastener, a steering bracket affixed to a steering shaft, and a second threaded fastener affixed to said steering bracket and passing through said opening for resiliently connecting said steering shaft and said outer casing.

2. A mounting arrangement for an outboard motor comprised of an outer casing as set forth in claim 1, wherein the elastic element comprises an annular element.

3. A mounting arrangement for an outboard motor comprised of an outer casing as set forth in claim 2, wherein the elastic element is bonded to an inner sleeve through which the fastener extends.

4. A mounting arrangement for an outboard motor comprised of an outer casing as set forth in claim 1, wherein the base plate has directly bonded to it a second elastic element transversely spaced apart from the first-mentioned elastic element, each having an opening for passing a respective second threaded fastener affixed to the steering bracket.

5. A mounting arrangement for an outboard motor comprised of an outer casing as set forth in claim 4, wherein the elastic elements comprise annular elements.

6. A mounting arrangement for an outboard motor comprised of an outer casing as set forth in claim 5, wherein the elastic elements are bonded to inner sleeves through which a respective second threaded fastener extends.

7. A mounting arrangement for an outboard motor comprised of an outer casing as set forth in claim 6, wherein the elastic elements are each bonded within a respective opening formed in a respective boss integrally formed with the base plate and wherein the bosses are transversely spaced apart.

8. A mounting arrangement for an outboard motor comprised of an outer casing as set forth in claim 7, further including an opening formed in the base plate between the bosses and through which a water tube extends for delivering water to the cooling system of an engine of the outboard motor.

9. A mounting arrangement for an outboard motor comprised of an outer casing as set forth in claim 8, wherein the elastic elements comprise annular elements.

10. A mounting arrangement for an outboard motor comprised of an outer casing as set forth in claim 1, wherein the outer casing is open at its upper end and the base plate closes at least a portion of the open upper end of the outer housing.

11. A mounting arrangement for an outboard motor comprised of an outer casing as set forth in claim 10, wherein the elastic element comprises an annular element.

12. A mounting arrangement for an outboard motor comprised of an outer casing as set forth in claim 11, wherein the elastic element is bonded to an inner sleeve through which the fastener extends.

13. A mounting arrangement for an outboard motor comprised of an outer casing as set forth in claim 10, wherein the base plate has directly bonded to it a second elastic element transversely spaced apart from the first-mentioned elastic element, each having an opening for passing a respective second threaded fastener affixed to the steering bracket.

14. A mounting arrangement for an outboard motor comprised of an outer casing as set forth in claim 13, wherein the elastic elements comprise annular elements.

15. A mounting arrangement for an outboard motor comprised of an outer casing as set forth in claim 14, wherein the elastic elements are bonded to inner sleeves through which a respective second threaded fastener extends.

16. A mounting arrangement for an outboard motor comprised of an outer casing as set forth in claim 13, wherein the elastic elements are each bonded within a respective opening formed in a respective boss integrally formed with the base plate and wherein the bosses are transversely spaced apart.

17. A mounting arrangement for an outboard motor comprised of an outer casing as set forth in claim 16, further including an opening formed in the base plate between the bosses and through which a water tube extends for delivering water to the cooling system of an engine of the outboard motor.

18. A mounting arrangement for an outboard motor comprised of an outer casing as set forth in claim 17, wherein the elastic elements comprise annular elements.

* * * * *